US008887709B2

(12) United States Patent
Ellis

(10) Patent No.: US 8,887,709 B2
(45) Date of Patent: Nov. 18, 2014

(54) FOLDABLE FUEL BURNER

(75) Inventor: Peter Ellis, Wimborne (GB)

(73) Assignee: Ellis Design Associates Limited, Wimborne (GB)

( * ) Notice: Subject to any disclaimer, the term of this patent is extended or adjusted under 35 U.S.C. 154(b) by 1393 days.

(21) Appl. No.: 12/093,701

(22) PCT Filed: Jul. 18, 2006

(86) PCT No.: PCT/GB2006/002666

§ 371 (c)(1),
(2), (4) Date: Sep. 22, 2008

(87) PCT Pub. No.: WO2007/057628

PCT Pub. Date: May 24, 2007

(65) Prior Publication Data

US 2009/0301470 A1 Dec. 10, 2009

(30) Foreign Application Priority Data

Nov. 15, 2005 (GB) ..... 0523234.3

(51) Int. Cl.
*F24C 1/16* (2006.01)
*F24B 1/20* (2006.01)

(52) U.S. Cl.
CPC ..... *F24B 1/205* (2013.01)
USPC ..... 126/9 R; 126/9 B; 126/25 B; 126/40; 126/43; 126/90 A; 220/6; 44/530; 44/535; 383/33

(58) Field of Classification Search
USPC ..... 126/9 R, 9 A, 9 B, 25 B, 40, 43; 44/530–535; 248/99; D7/417; 141/390; 383/33
See application file for complete search history.

(56) References Cited

U.S. PATENT DOCUMENTS

| | | | | | |
|---|---|---|---|---|---|
| 492,896 | A | * | 3/1893 | Sohner | 362/162 |
| 610,194 | A | * | 9/1898 | Neil | 362/162 |
| 1,037,539 | A | * | 9/1912 | Rodgers | 220/495 |
| 1,238,142 | A | * | 8/1917 | Hitchcock | 126/29 |
| 1,467,815 | A | * | 9/1923 | Roemer | 126/59 |
| 1,584,940 | A | * | 5/1926 | Hornecker | 248/174 |
| 1,651,818 | A | * | 12/1927 | Gorrell | 110/241 |
| 1,879,837 | A | * | 9/1932 | Bierlich | 126/43 |
| 2,038,226 | A | * | 4/1936 | Lang | 126/25 R |
| 2,374,128 | A | * | 4/1945 | Pinckert | 138/141 |

(Continued)

FOREIGN PATENT DOCUMENTS

WO 9937955 A1 7/1999

*Primary Examiner* — Steven B McAllister
*Assistant Examiner* — Nikhil Mashruwala
(74) *Attorney, Agent, or Firm* — Christensen O'Connor Johnson Kindness PLLC

(57) ABSTRACT

A foldable burner (10) is shown in the assembled and expanded condition. Foldable burner (10) comprises a raised platform (12) formed from aluminum foil portions (4*b*) and (4*c*) onto which fuel (14) can be placed. Tabs (16) are provided for gripping by a user to expand the burner from the collapsed condition to the expanded condition. Tabs (16) may also act as supports to strengthen the burner (10) and make the burner (10) more stable. Pluralities of apertures (8) enable air to enter the burner (10) under a chimney effect in order to provide oxygen to fuel (14) for burning. The upper periphery (18) of the burner (10) provides support for a cooking vessel (20) such as a saucepan. The burner (10) is easy to transport in its folded condition. Further, it may be designed as to offer a second use as transportation box.

10 Claims, 6 Drawing Sheets

(56) References Cited

U.S. PATENT DOCUMENTS

| | | | | | |
|---|---|---|---|---|---|
| 2,424,665 | A | * | 7/1947 | Pope, Sr. | 126/9 R |
| 2,488,014 | A | * | 11/1949 | Higman | 126/59 |
| 2,735,606 | A | * | 2/1956 | Paige | 206/418 |
| 3,035,566 | A | * | 5/1962 | Keeney | 126/25 R |
| 3,123,062 | A | * | 3/1964 | Psarris | 126/25 B |
| 3,374,071 | A | * | 3/1968 | Corriher, Jr. et al. | 44/521 |
| 3,384,066 | A | * | 5/1968 | Tufts | 126/9 R |
| 3,490,507 | A | * | 1/1970 | Grashorn | 383/109 |
| 3,494,349 | A | * | 2/1970 | Allen | 126/25 B |
| D217,184 | S | * | 4/1970 | Davis | D7/417 |
| 3,575,156 | A | * | 4/1971 | Hosford | 126/25 R |
| 3,589,353 | A | * | 6/1971 | Sanders | 126/9 A |
| 3,611,912 | A | * | 10/1971 | Choc | 99/340 |
| 3,637,335 | A | * | 1/1972 | Uhl | 431/291 |
| D223,722 | S | * | 5/1972 | Stehouwer | D7/417 |
| 3,667,446 | A | * | 6/1972 | Morton | 126/9 R |
| 3,682,154 | A | * | 8/1972 | Mollere | 126/9 A |
| 3,734,034 | A | * | 5/1973 | Fowler | 126/25 B |
| 3,934,520 | A | * | 1/1976 | Brennan et al. | 126/25 B |
| 4,037,778 | A | * | 7/1977 | Boyle | 141/390 |
| 4,130,103 | A | * | 12/1978 | Zimmerman | 126/25 B |
| 4,175,925 | A | * | 11/1979 | Paek et al. | 44/540 |
| 4,240,363 | A | * | 12/1980 | Troy | 383/30 |
| 4,461,270 | A | * | 7/1984 | Sutter | 126/25 B |
| 4,624,238 | A | * | 11/1986 | Hait | 126/9 R |
| 4,714,013 | A | * | 12/1987 | Telfer | 99/449 |
| 4,784,112 | A | * | 11/1988 | Hayashi | 126/262 |
| 4,794,906 | A | * | 1/1989 | Longley, Jr. | 126/9 R |
| 4,896,650 | A | * | 1/1990 | Hait | 126/9 R |
| 4,907,140 | A | * | 3/1990 | Overstreet | 362/162 |
| 4,938,202 | A | * | 7/1990 | Hait | 126/9 R |
| 4,940,200 | A | * | 7/1990 | Sawyer et al. | 248/97 |
| 4,979,547 | A | * | 12/1990 | Hoerner | 141/390 |
| 5,074,279 | A | * | 12/1991 | Sainsbury | 126/25 B |
| 5,134,990 | A | * | 8/1992 | Bradfield | 126/25 B |
| 5,264,996 | A | * | 11/1993 | Bele et al. | 362/162 |
| 5,269,286 | A | * | 12/1993 | Cowan | 126/25 B |
| D377,582 | S | * | 1/1997 | Yang | D7/507 |
| 5,785,046 | A | * | 7/1998 | Colla | 126/9 R |
| 5,897,084 | A | * | 4/1999 | Judge | 248/95 |
| 6,851,419 | B2 | * | 2/2005 | Reiner | 126/9 B |
| 7,934,495 | B2 | * | 5/2011 | Goldenberg | 126/343.5 R |
| 2003/0147566 | A1 | * | 8/2003 | Brocking | 383/84 |

* cited by examiner

FOLDABLE FUEL BURNER

BACKGROUND OF THE INVENTION

The present invention relates to foldable burners and relates particularly, but not exclusively, to a foldable burner that can be made from a flat sheet of material.

Portable burners that burn solid fuel are known for use in a variety of situations, such as camping and earthquake relief or other disaster relief. Known foldable burners can suffer from the drawbacks of being heavy and bulky and therefore difficult to carry. In addition, known burners suffer from the disadvantage that effective combustion of fuel does not occur.

BRIEF SUMMARY OF THE INVENTION

Preferred embodiments of the present invention seek to overcome the above disadvantages of the prior art.

According to an aspect of the present invention, there is provided a collapsible burner comprising a body at least partially formed from flame proof flexible material, the body defining sidewalls and a support for supporting combustible fuel, wherein the body has an unfolded condition in which the body is adapted to support a vessel to be heated and the support extends between the sidewalls to support combustible fuel for heating the vessel, and a folded condition in which the body is substantially flat.

This provides the advantage that the burner can be used in the first condition to burn fuel to provide heat for cooking, and when the burner is required to be packed away for transport, it can be folded into the substantially flat second condition to facilitate transportation.

In a preferred embodiment, the sidewalls are adapted to support a vessel in the unfolded condition.

The burner may further comprise at least one tab for gripping by a user to move the body between the folded and unfolded conditions.

At least one said tab may be adapted to provide stability to the body in the unfolded condition thereof.

This provides the advantage of making the burner stronger and more stable.

Said flame proof flexible material may include metal foil attached to a mesh support.

In a preferred embodiment, said mesh includes holes having inclined walls.

This provides the advantage of aiding air flow into the burner to aid fuel combustion.

The burner may further comprise at least one first air inlet in at least one said sidewall.

At least one said first air inlet may comprise at least one first aperture in said foil.

The burner may further comprise at least one second air inlet between said support and at least one said sidewall.

This provides the advantage of further aiding air flow into the burner to aid fuel combustion.

According to another aspect of the present invention, there is provided a sheet of foldable material having a first folded condition defining a collapsible burner as defined above, and a second condition defining a box for storing goods.

This provides the advantage that the sheet of material can be used for several purposes. For example, the sheet of material can be folded in the first condition to form a box for storing goods such as food and fuel for use with the collapsible burner, and when the burner is required to be used the box can be opened out and folded into the second condition to form the burner.

BRIEF DESCRIPTION OF THE SEVERAL VIEWS OF THE DRAWINGS

Preferred embodiments of the present invention will now be described, by way of example only, and not in any limitative sense, with reference to the accompanying drawings in which.

DETAILED DESCRIPTION OF THE INVENTION

Figure 1:
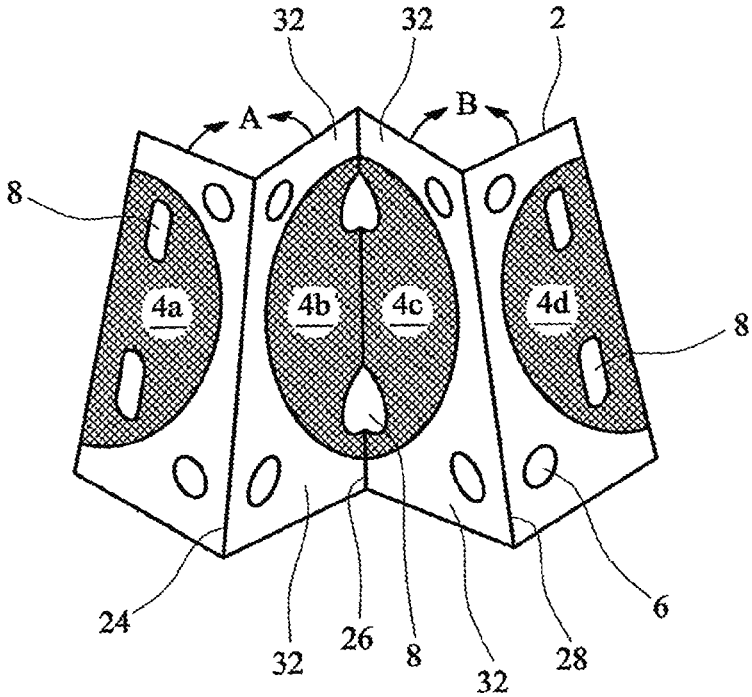
FIG. 1 is a perspective view of a flat sheet for forming a foldable burner of a first embodiment of the present invention.

Referring to FIG. 1, a flat sheet of material 2 comprises a sheet of plastics material onto which four semicircular sheets of aluminum foil 4*a* to 4*d* are bonded. A plurality of first apertures 6 and second apertures 8 are formed in the sheet 2 for allowing air into the assembled burner (FIG. 2) to aid burning.

Figure 2:
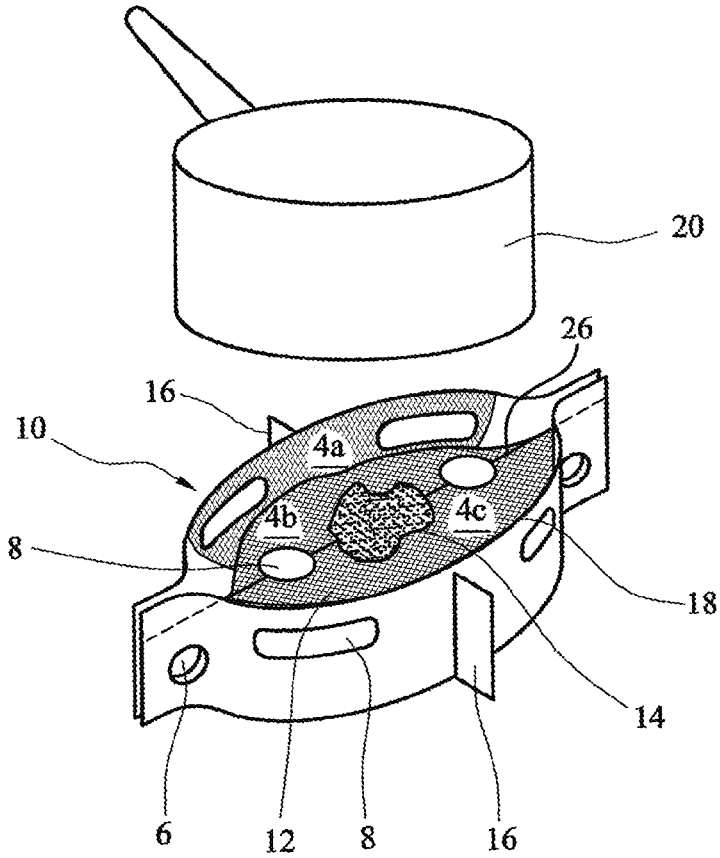
FIG. 2 is a perspective view of a burner of a first embodiment of the present invention assembled from the sheet of FIG. 1.

Referring to FIG. 2, burner 10 is shown in the assembled and expanded condition. It should be understood that sheet 2 (FIG. 1) is first folded and bonded in a manner that will be described below, to form the collapsed burner (FIG. 3) which is then expanded into the burner 10 shown in FIG. 2. Burner 10 comprises a raised platform 12 formed from aluminum foil portions 4*b* and 4*c* onto which fuel 14 can be placed. Tabs 16 are provided for gripping by a user to unfold the burner from the collapsed condition (FIG. 3) to the expanded condition (FIG. 2). Tabs 16 may also act as supports to strengthen the burner 10 and make the burner 10 more stable. The first apertures 6 and second apertures 8 enable air to enter the burner 10 under a chimney effect in order to provide oxygen to fuel 14 for burning. The upper periphery 18 of the burner 10 provides support for a cooking vessel 20 such as a saucepan.

Figure 3:
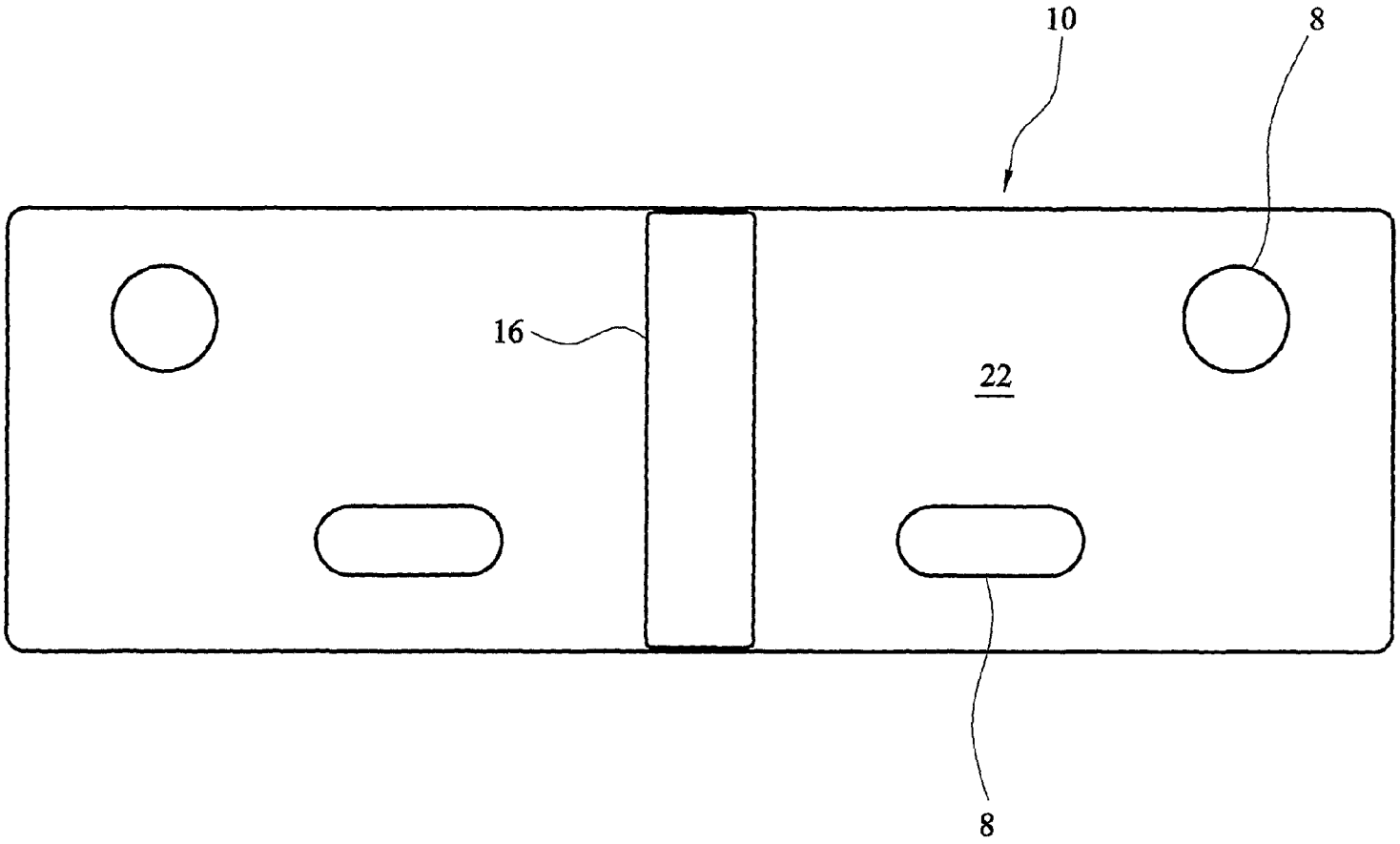
FIG. 3 is a side view of the burner of FIG. 2 in the collapsed condition.

Referring to FIG. 3, the burner 10 is shown in the collapsed condition. Tab 16 is folded against the sidewall 22 and raised platform 12 (not shown) is folded upwardly such that the burner 10 is collapsed into a substantially flat shape that is easy to pack and carry.

Referring again to FIG. 1, the method of constructing the burner 10 from flat sheet 2 will now be described.

Flat sheet 2 comprises a plastic sheet onto which aluminum foil portions 4*a* to 4*d* are bonded. Three fold lines 24, 26 and 28 are formed in the flat sheet 2 and the sheet is then folded in a concertina-like manner in the directions of arrows A and B such that flat sheet 2 forms a smaller folded flat sheet as shown in the configuration of FIG. 3. The areas of the flat sheet 2 not covered by aluminum foil portions 4*a* to 4*d* are then bonded together by means of heating the plastic layer or by means of glue. The reverse sides of the regions of flat sheet 2 shown generally by reference numerals 32 are also bonded together to complete the assembled burner 10.

Consequently, when tabs 16 are extended and pulled outwardly, the bonded edges 32 are prevented from opening outwardly but the regions around aluminum foil portions 4*a* and 4*d* move outwardly to form burner 10. Aluminum foil portions 4*a* and 4*d* form substantially fireproof inner walls of the burner 10 and the aluminum foil portions 4*b* and 4*c* form the raised platform 12 on which fuel 14 to be burned can be placed.

Figure 4:
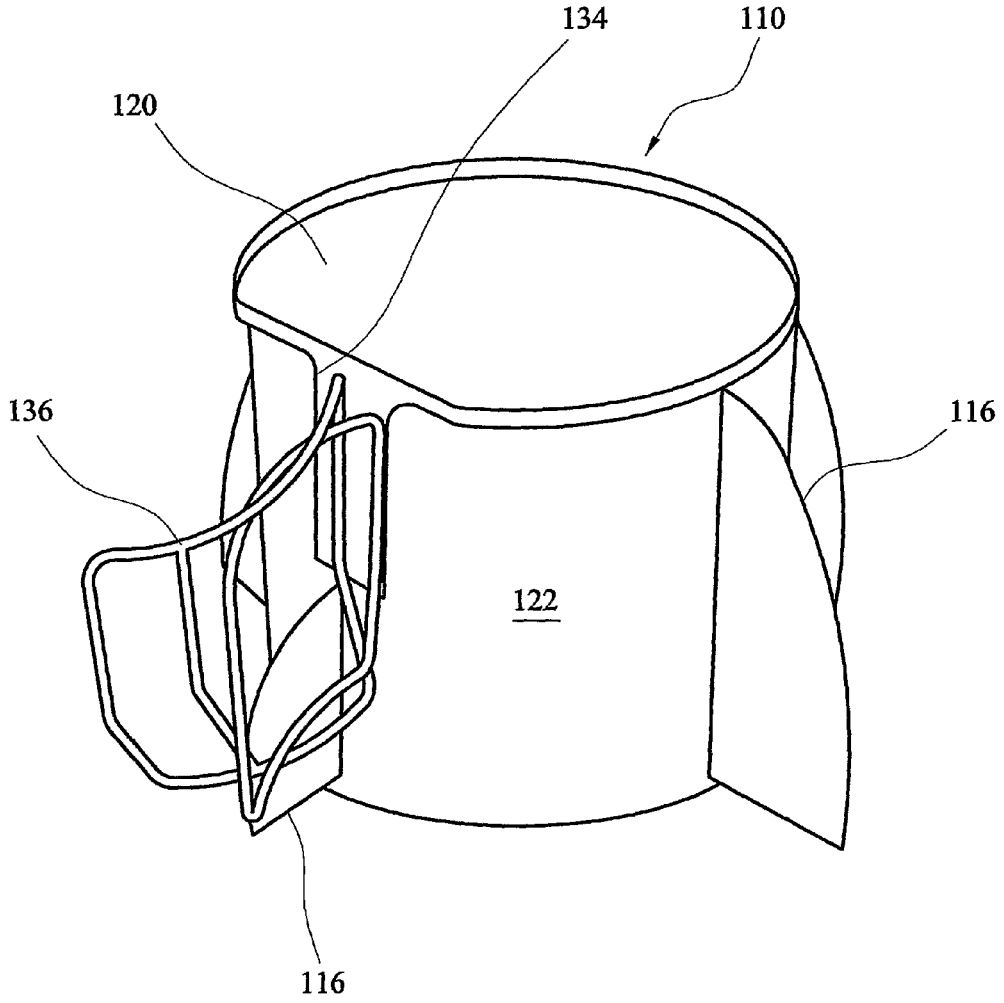
FIG. 4 is a perspective view of a burner of a second embodiment of the present invention in the assembled condition and supporting a mug.
Figure 5:
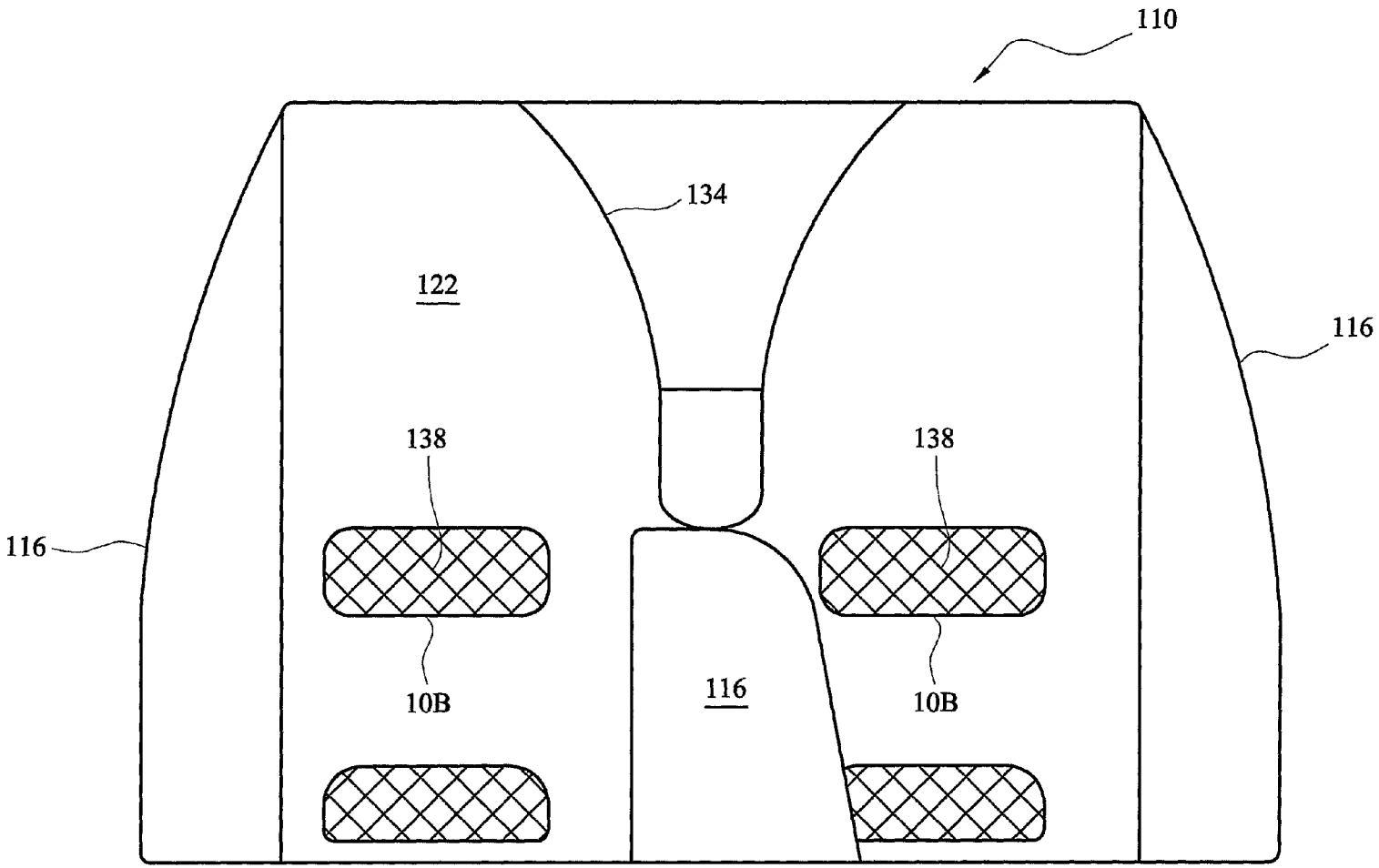
FIG. 5 is a side view of the burner of FIG. 4 in the collapsed condition.

A foldable burner of a second embodiment of the invention is shown in FIGS. 4 and 5, with parts common to the embodiment of FIGS. 1 to 3 denoted by like reference numerals but increased by 100.

Burner 110 is substantially taller than the burner 10 shown in FIGS. 1 to 3. A recess 134 is formed in the walls of burner 110 such that a cooking vessel 120 in the form of a metal mug can be placed such that the handle 136 of the mug extends outwardly of burner 110. Tabs 116 are foldable against the sidewalls 122 of the burner 110. Wire mesh 138 is disposed inside burner 110 in order to reinforce the walls of the burner 110. A plurality of apertures 108 is also provided to enable air to enter the burner and aid burning.

Referring to FIG. 1, it can be seen that the foldable burner is formed from a substantially flat sheet 2 of material. The flat sheet 2 of material can also be used to form the sidewalls of a box for example for holding fuel to be transported. A plurality of removable tabs (not shown) could be provided to enable the box to be rigidly assembled from a flat net formed by the sheet 2 that can be folded into a box in the manner of commercially available boxes used for packaging. When the burner is required to be assembled, the box could be opened out into the flat sheet format and the flat sheet then folded and bonded in the manner described above.

Figure 6:
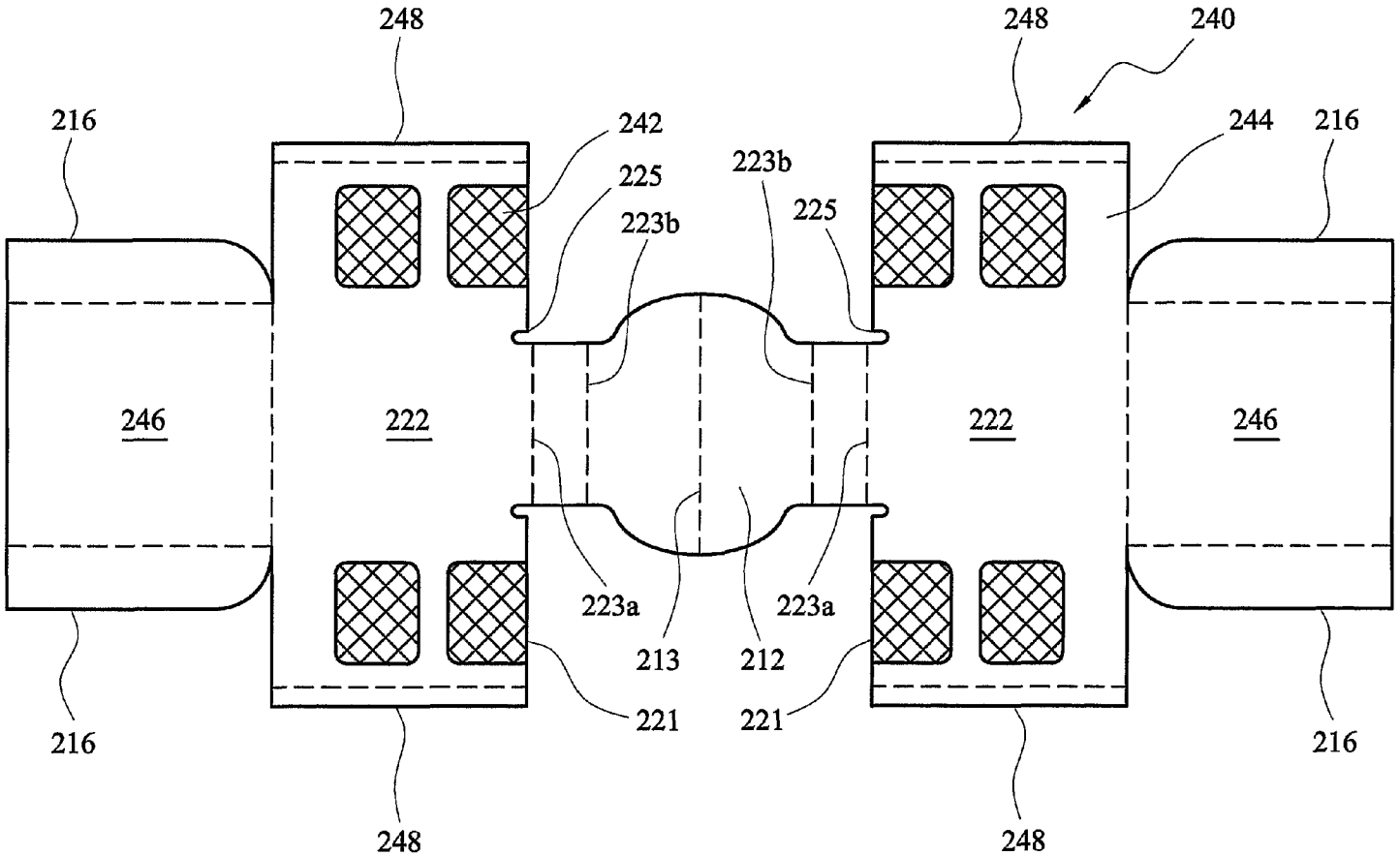
FIG. 6 is a plan view of a net for forming a burner of a third embodiment of the present invention.

Referring to FIG. 6, a foldable burner of a third embodiment of the invention will now be described.

A net 240 comprises a base of wire mesh 242 onto which metal foil 244 is bonded. Mesh 242 has angled holes (i.e. holes having inclined walls in the direction moving from the inside to the outside of the burner) to encourage airflow into the assembled burner. A platform 212 is formed in the net and has a centre fold line 213. Centre fold line 213 permits the platform 212 to fold in half when the assembled burner (not shown) is collapsed. Sidewalls 222 are connected to the platform 212 and end flaps 246 are connected to the sidewalls 222. The end flaps 246 are connected to fins 216.

In order to form the burner from the net 240, a first fold is made along centre fold line 213 such that sidewalls 222 are facing each other. Second folds are then made along sidewall fold lines 223*a* and 223*b* such that the insides of sidewalls 222 now face each other and a raised platform 212 is created between the sidewalls 222. Edges 248 of the sidewalls can then be bonded together by means of gluing, crimping or other means in order to form a substantially cylindrical burner, the cylindrical shape defined by sidewalls 222. In this form, there is a gap between the bottom edge 221 of the sidewalls and the platform 212 in order to enable air to enter the burner. End flaps 246 can then be folded against the outside of sidewalls 222 and bonded thereto, to enable fins 216 to be folded outwardly to provide stability for the burner. Notches 225 are formed in the bottom edges 221 of sidewalls 222 in order to enable folding of the sidewalls 222 into a cylindrical shape since fold lines 223*a* are substantially straight.

The assembled burner can be collapsed into a substantially flat shape in the manner of the first and second embodiments described above.

Figure 7:
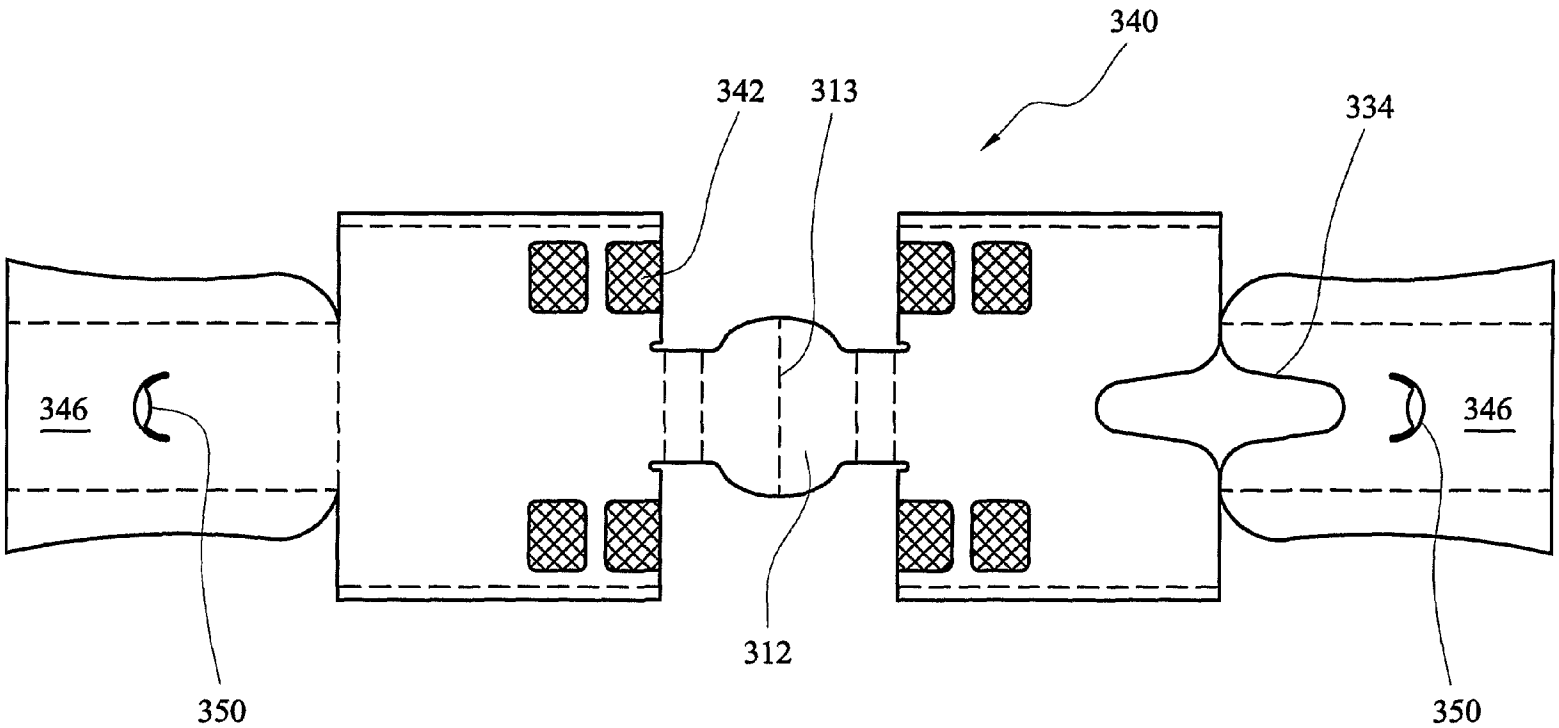
FIG. 7 is a plan view of a net for forming a burner of a fourth embodiment of the present invention.

Referring to FIG. 7, a foldable burner of a fourth embodiment of the invention is shown, with parts common to the embodiment of FIG. 6 denoted by like reference numerals but increased by 100.

Net 340 comprises a recess portion 334 which when folded forms a recess for the handle of a mug (not shown). A mug (not shown) can be placed in the burner formed by net 340 and supported at the upper part of the sidewalls so that there is a gap between the bottom of the mug and the platform 312 on which fuel is supported. The holes of mesh 342 are angled such that when the burner is formed, the holes of mesh 342 are angled upwardly to encourage air flow into the burner. Tabs 350 are disposed on end flaps 346 to enable the burner (not shown) to be pulled out from the collapsed condition in to the condition for burning. Centre fold line 313 enables the raised platform 312 to be folded in half in the collapsed condition of the burner.

It will be appreciated by persons skilled in the art that the above embodiment has been described by way of example only and not in any limitative sense, and that various alterations and modifications are possible without departure from the scope of the invention as defined by the appended claims.

The invention claimed is:

1. A collapsible burner comprising a body formed from a flat sheet of flexible material having three parallel fold lines and comprising a sheet of plastic material and first and second metal foil portions bonded onto the sheet of plastic material, whereby:

the collapsible burner is adapted to be arranged in a collapsed condition in which the sheet of flexible material is folded along the fold lines so as to be substantially flat, and expanded from the collapsed condition to an expanded condition in which the sheet of flexible material is unfolded so that the second metal foil portions form a raised platform adapted to have fuel to be burned placed thereon;

and part of the sheet of flexible material including the first portions of the metal foil forms sidewalls and is arranged to form substantially fireproof inner walls of the burner;

wherein the sidewalls, when in the expanded condition, are adapted to extend above at least a portion of the raised platform thereby forming an upper periphery of the burner adapted to support a vessel to be heated above the raised platform which extends between the sidewalls to support combustible fuel for heating the vessel.

2. A burner according to claim 1, wherein the sidewalls are adapted to support a vessel in the unfolded condition.

3. A burner according to claim 1, further comprising at least one tab which is foldable against one of the sidewalls and arranged for gripping by a user to move the burner between the folded and expanded conditions.

4. A burner according to claim 3, wherein the at least one tab is adapted to be folded outwards from said one of the sidewalls to provide stability to the burner in the unfolded condition thereof.

5. A burner according to claim 1, wherein there is at least one first aperture in at least one of the sidewalls for allowing air into the burner.

6. A collapsible burner comprising a body formed from plastic sheet material which is foldable along three parallel fold lines, and first and second portions of metal foil bonded onto the sheet material, wherein the sheet material is folded whereby:

the collapsible burner is adapted to be arranged in a collapsed condition in which the body is folded along the fold lines so as to be substantially flat, and expanded from the collapsed condition to an expanded condition in which the body is unfolded to form a raised platform adapted to have fuel to be burned placed thereon, the raised platform being formed at least partially from the second portions of metal foil;

and part of the sheet material forms sidewalls also formed from the first parts of the metal foil and arranged to form substantially fireproof inner walls of the burner;

wherein the sidewalls when in the expanded condition, are adapted to extend above at least a portion of the raised platform thereby forming an upper periphery of the burner adapted to support a vessel to be heated above the raised platform which extends between the sidewalls to support combustible fuel for heating the vessel.

7. A burner according to claim 6, wherein the sidewalls are adapted to support a vessel in the unfolded condition.

8. A burner according to claim 6, further comprising at least one tab which is foldable against one of the sidewalls and arranged for gripping by a user to move the burner between the folded and expanded conditions.

9. A burner according to claim 8, wherein the at least one tab is adapted to be folded outwards from said one of the sidewalls to provide stability to the burner in the unfolded condition thereof.

10. A burner according to claim 6, wherein there is at least one first aperture in at least one of the sidewalls for allowing air into the burner.

* * * * *